US007479034B2

(12) United States Patent
Blakborn et al.

(10) Patent No.: US 7,479,034 B2
(45) Date of Patent: Jan. 20, 2009

(54) INSERTION-CONNECTED CONNECTOR

(75) Inventors: Willem Blakborn, Inzell (DE); Jens-Peter Fruendt, Kaltenkirchen (DE)

(73) Assignee: Rosenberger Hochfrequenztechnik GmbH & Co., Fridolfing (DE)

( * ) Notice: Subject to any disclaimer, the term of this patent is extended or adjusted under 35 U.S.C. 154(b) by 0 days.

(21) Appl. No.: 11/908,420

(22) PCT Filed: Mar. 21, 2006

(86) PCT No.: PCT/EP2006/002575

§ 371 (c)(1),
(2), (4) Date: Sep. 12, 2007

(87) PCT Pub. No.: WO2006/100035

PCT Pub. Date: Sep. 28, 2006

(65) Prior Publication Data

US 2008/0227332 A1 Sep. 18, 2008

(30) Foreign Application Priority Data

Mar. 22, 2005 (DE) ..... 10 2005 013 282

(51) Int. Cl.
*H01R 9/05* (2006.01)

(52) U.S. Cl. ..... 439/578; 439/638; 439/701; 439/248

(58) Field of Classification Search ..... 439/246–248, 439/578–585, 638, 540.1, 541.5, 701; 174/117 F
See application file for complete search history.

(56) References Cited

U.S. PATENT DOCUMENTS

| | | | | | |
|---|---|---|---|---|---|
| 3,094,364 | A | * | 6/1963 | Liagg | 439/247 |
| 4,227,765 | A | * | 10/1980 | Neumann et al. | 439/248 |
| 4,580,862 | A | * | 4/1986 | Johnson | 439/248 |
| 4,909,748 | A | | 3/1990 | Kozono et al. | |
| 5,002,497 | A | * | 3/1991 | Plocek et al. | 439/248 |
| 5,516,303 | A | * | 5/1996 | Yohn et al. | 439/248 |
| 5,649,834 | A | * | 7/1997 | Allison et al. | 439/247 |

(Continued)

FOREIGN PATENT DOCUMENTS

DE 19641001 A 4/1997

(Continued)

*Primary Examiner*—Alexander Gilman
(74) *Attorney, Agent, or Firm*—DeLio & Peterson LLC; Robert Curcio

(57) ABSTRACT

The invention relates to a plug connector (100) with a housing (110) and with at least two electrical contact elements (112), which each have a longitudinal axis and which are arranged so that they are aligned on a plugging side of the housing (110) at predetermined positions and with a respective longitudinal axis parallel to a plugging direction (122) of the plug connector (100). Each electrical contact element (112) is placed inside the housing (100) in a manner that enables it to move in a plane perpendicular to the plugging direction (122), and is connected in an elastically resilient manner to at least one second electrical contact element (112) via at least one electrically non-conductive elastic spring element (114). The elastic spring element (114) is arranged and designed so that the electrical contact elements (112) are pre-positioned at the respective pre-positioned position up to tolerance allowances, and they can be displaced in an elastically resilient manner from this position in the plane perpendicular to the plugging direction (122).

23 Claims, 9 Drawing Sheets

U.S. PATENT DOCUMENTS

| | | | | |
|---|---|---|---|---|
| 5,769,652 | A * | 6/1998 | Wider | 439/248 |
| 5,885,103 | A * | 3/1999 | Ernolf et al. | 439/579 |
| 6,428,355 | B1 * | 8/2002 | Machado | 439/578 |
| 6,679,726 | B1 * | 1/2004 | Tunn et al. | 439/565 |
| 7,371,967 | B2 * | 5/2008 | MaHoney et al. | 174/117 F |

FOREIGN PATENT DOCUMENTS

| | | | |
|---|---|---|---|
| EP | 0928047 | A | 7/1999 |
| EP | 1361629 | A | 11/2003 |

* cited by examiner

INSERTION-CONNECTED CONNECTOR

The present invention relates to an insertion-connected connector having a housing and having at least two electrical contact elements which each have a longitudinal axis and which are arranged in predetermined positions on an insertion side of the housing, orientated to have their respective longitudinal axes parallel to a direction of insertion of the insertion-connected connector, as defined in the preamble to claim 1.

To make an electrical connection between, on the one hand, a plurality of cable ends, which cable ends are each provided with appropriate contact elements such for example as co-axial insertion-connected connectors, pin contacts or receptacle contacts, and, on the other hand, a plurality of cable ends having appropriate complementary contact elements, such for example as co-axial plugs/couplers or receptacle contacts/pin contacts, or a plurality of complementary contact elements on the case of a piece of equipment, it has been necessary hitherto for each individual pair of contact elements to be plugged together manually as a separate operation. What is meant by the term "contact element" in the present case is any kind of insertion-connected contact having one, two, or more conductors, such for example as co-axial insertion-connected connectors in the form of co-axial plugs and co-axial sockets, and pin contacts and receptacle contacts. What is meant by "complementary contact element" or "mating contact element" is the associated insertion-connected contact in the given case in which the "contact element" can be inserted, i.e., if for example the co-axial plug is the "contact element" then the co-axial coupler is the "complementary contact element", or if the pin contact is the "contact element" then the receptacle contact is the "complementary contact element". What is meant by "insertion-connected connector" in the present document is a component which has two or more "contact elements", and the "complementary insertion-connected connector" has the "complementary contact element" which corresponds to the "contact elements" of the "insertion-connected connector". It is not essential for all the plurality of "contact elements" to be the same. Co-axial insertion-connected connectors may also be mixed with pin/receptacle contacts for example. Nor does the "pin" or "receptacle" type necessarily need to be identical for all the "contact elements" of an "insertion-connected connector". Instead, co-axial couplers and co-axial plugs may also be mixed in an "insertion-connected connector".

For example, where a motor vehicle roof aerial has a plurality of aerials, such as a mobile phone aerial and a GPS aerial, to connect it electrically to corresponding pieces of equipment, such for example as a mobile phone and a GPS receiver, it has been usual hitherto for cables which are provided at their free ends with appropriate contact elements to be run from the housing of the motor vehicle roof aerial. These contact elements are then connected, separately and individually, to complementary contact elements belonging to cables which run on to the pieces of equipment. However, this type of electrical connection is complicated and cost-intensive.

The object underlying the invention is to improve an insertion-connected connector of the above-mentioned type in respect of fitting and electrical contact.

This object is achieved in accordance with the invention by an insertion-connected connector of the above-mentioned type having the features characterised in claim 1. Advantageous embodiments of the invention are described in the other claims.

In an insertion-connected connector of the above-mentioned type, provision is made in accordance with the invention for each electrical contact element to be arranged in the housing to be movable in a plane perpendicular to the direction of insertion and to be connected, in an elastically resilient manner, to at least one second electrical contact element by means of at least one electrically insulating elastic resilient member, the elastic resilient member being so arranged and formed that the electrical contact elements are, except for differences due to tolerances, pre-positioned at the respective predetermined positions and can be deflected, in an elastically resilient manner, from these locations in the plane perpendicular to the direction of insertion.

This has the advantage that the contact elements are suspended in such a way as to float elastically and in this way differences due to tolerances between the positions of the electrical contact elements of the insertion-connected connector and the corresponding complementary electrical contact elements or mating electrical contact elements in a complementary insertion-connected connector in which the complementary electrical contact elements or mating electrical contact elements are rigidly arranged are automatically compensated for by elastic deflection of the electrical contact elements of the insertion-connected connector when the insertion-connected connector and the complementary insertion-connected connector are plugged together, and good electrical contact is ensured between any given electrical contact elements of an insertion-connected connector and a complementary insertion-connected connector in spite of any differences in their respective positions due to tolerances.

To provide a means of compensating for tolerances which is as flexible as possible, the electrical contact elements are arranged in the housing of the insertion-connected connector to be movable in such a way that the mobility of the electrical contact elements in the plane perpendicular to the direction of insertion encompasses tilting of the longitudinal axes of the electrical contact elements and/or a displacement thereof in translation in a parallel position.

In a preferred embodiment, each electrical contact element is in the form of a co-axial insertion-connected connector having a centre conductor and an outer conductor.

To allow signals to travel onward via the insertion-connected connector, each electrical contact element is connected to a signal conductor member which in each case connects an electrical contact element electrically to a connecting point for a cable.

Each signal conductor member is for example in the form of a co-axial line or a strip line and, as an option, may have electrical screening.

In a particularly preferred embodiment, all the signal conductor members are arranged to extend in a plane at right angles to the direction of insertion, starting from the given contact element, each signal conductor member being in the form of a rigid component and a recess being provided in the housing for each signal conductor member and being so formed that each signal conductor member can be moved, together with the associated contact element, in a plane perpendicular to the direction of insertion.

Each electrical contact element is usefully surrounded by an electrically insulating sleeve and each sleeve of an electrical contact element is usefully connected in an elastically resilient manner to a sleeve of an adjacent electrical contact element by means of a respective electrically insulating elastic resilient member, the resilient members being formed to be Ω-shaped for example in a cross-sectional plane perpendicular to the direction of insertion and the sleeves and resilient members being formed to be in one piece with one another to form a resilient housing.

First latching means are formed on the housing and on each resilient member are formed second latching means which, by co-operating with the first latching means, fix the resilient members, and with them the electrical contact elements, to the housing.

In a preferred embodiment, each first latching means comprises an elastically resilient tongue which rises from the housing in the direction of insertion and which has a recess, with each second latching means comprising a latching nose which rises from the given resilient member perpendicularly to the direction of insertion and fits into the recess in the resilient tongue comprising the first latching means.

Mechanical coding which stops any unwanted incorrect insertion of the insertion-connected connector according to the invention is achieved by virtue of the fact that at least one of the tongues comprising the first latching means on the housing is of a different width from the other tongues.

To allow the insertion-connected connector to be secured in the inserted state, there rise from the housing in the direction of insertion at least two, and in particular three, latching spigots spaced apart from one another having respective latching noses which are formed to latch into a housing or insertion interface which carries contact elements complementary to the electrical contact elements of the insertion-connected connector.

The invention will be explained in detail below by reference to the drawings. In the drawings.

Figure 1:
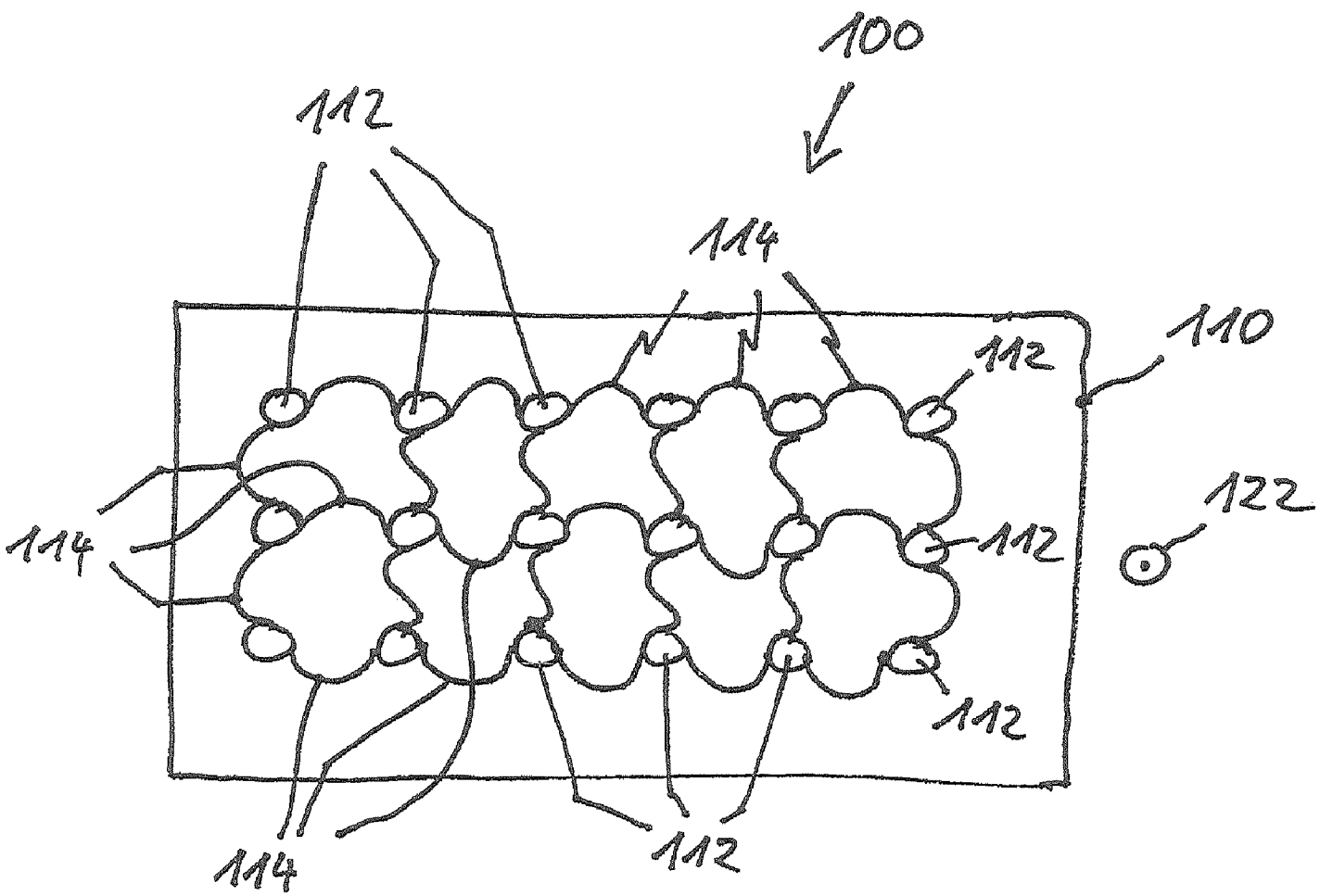
FIG. 1 is a schematic plan view of the insertion side of a first preferred embodiment of insertion-connected connector according to the invention.

The first preferred embodiment of insertion-connected connector 100 according to the invention, which can be seen in schematic form in FIG. 1, comprises a housing 110 in which are arranged elongated receptacle contacts 112 of which only the end-faces can be seen in the plan view in FIG. 1. These receptacle contacts 112 are connected together by a network of elastic resilient members 114 and by means of this network of resilient members 114 are fixed, inside the housing 110, at positions corresponding to desired measurements (desired positions) for the receptacle contacts 112. These positions correspond to the positions of pin contacts within a housing of a mating insertion-connected connector or complementary insertion-connected connector into which the insertion-connected connector can be inserted. It is true that the receptacle contacts 112 are, in principle, pre-positioned by the network of resilient members 114 at the positions given by the desired measurements but, due to the elasticity of the resilient members 114 in the plane of the drawing, which latter is perpendicular to a direction of insertion 122 of the insertion-connected connector 100, they may be deflected elastically from their respective desired positions. When this happens, each receptacle contact 112 may, in the plane of the drawing, move away from the said desired position in a random direction independently of the other receptacle contacts 112. The network of resilient members 114 is so formed in this case that each receptacle contact 112 can move from the desired position set by the desired measurements for the individual contacts by an amount of the same order as the differences caused by tolerances. If the insertion-connected connector 100 according to the invention is now inserted in a mating insertion-connected connector or complementary insertion-connected connector (not shown) having corresponding pin contacts, the pin contacts being rigidly arranged in the mating insertion-connected connector, the receptacle contacts 112 are able to move slightly out of their respective desired positions to adjust to corresponding pin contacts which are fixed rigidly, i.e. solidly, in position in the mating insertion-connected connector with a difference caused by tolerances from their desired position set by the desired measurements. This enables contact elements arranged in a matrix to be plugged together without mechanical stresses or damage which would have an adverse effect on the electrical contact occurring within the contact elements, when they are plugged together, as a result of differences caused by tolerances in the positions of contact plugs or pins or contact receptacles. It goes without saying that contact pins may also be provided in the insertion-connected connector according to the invention and that contact receptacles may thus also be provided in the mating insertion-connected connector. Receptacles and pins may also be mixed in the insertion-connected connector, in which case the mating insertion-connected connector then has a mixture of receptacles and pins which is complementary in the appropriate way.

Figure 2:
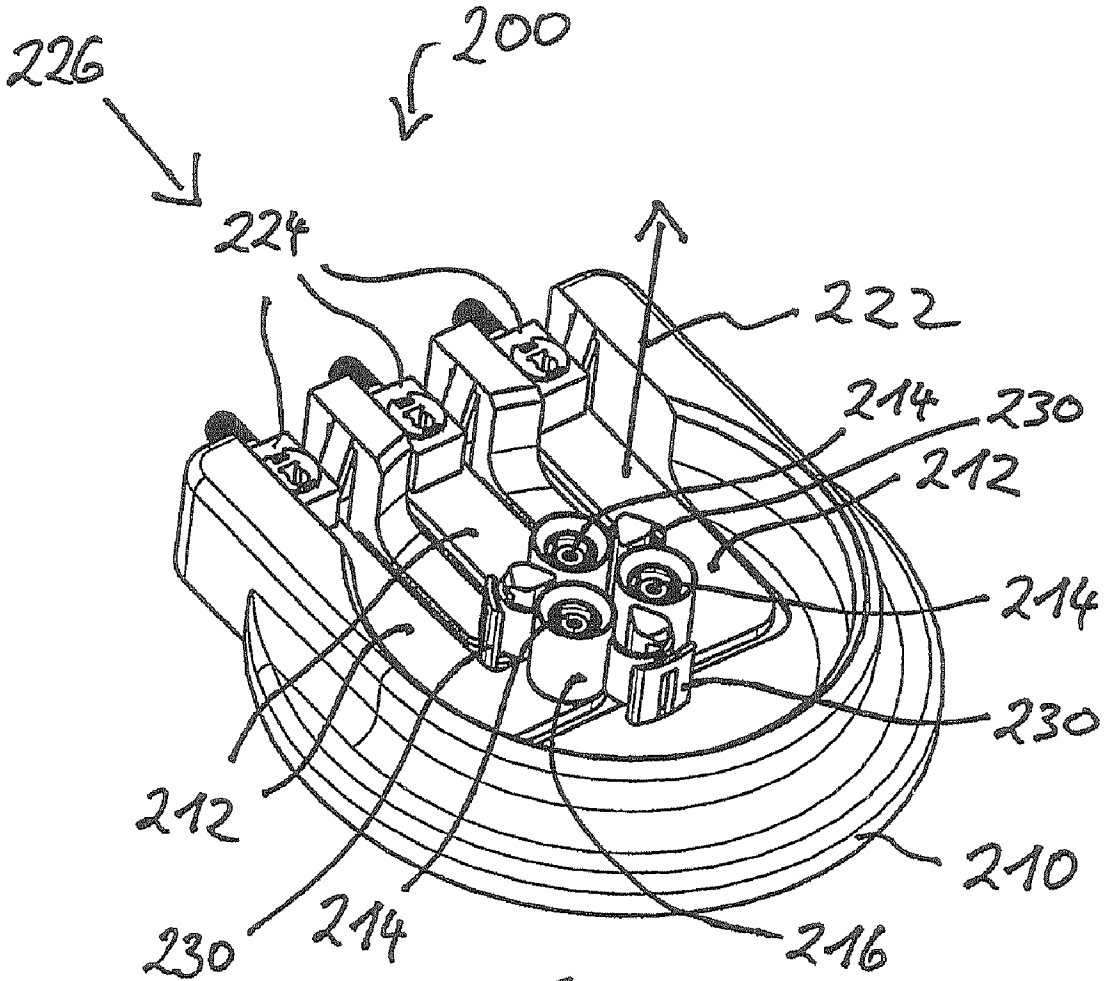
FIG. 2 is a perspective view of a second preferred embodiment of insertion-connected connector according to the invention.
Figure 6:
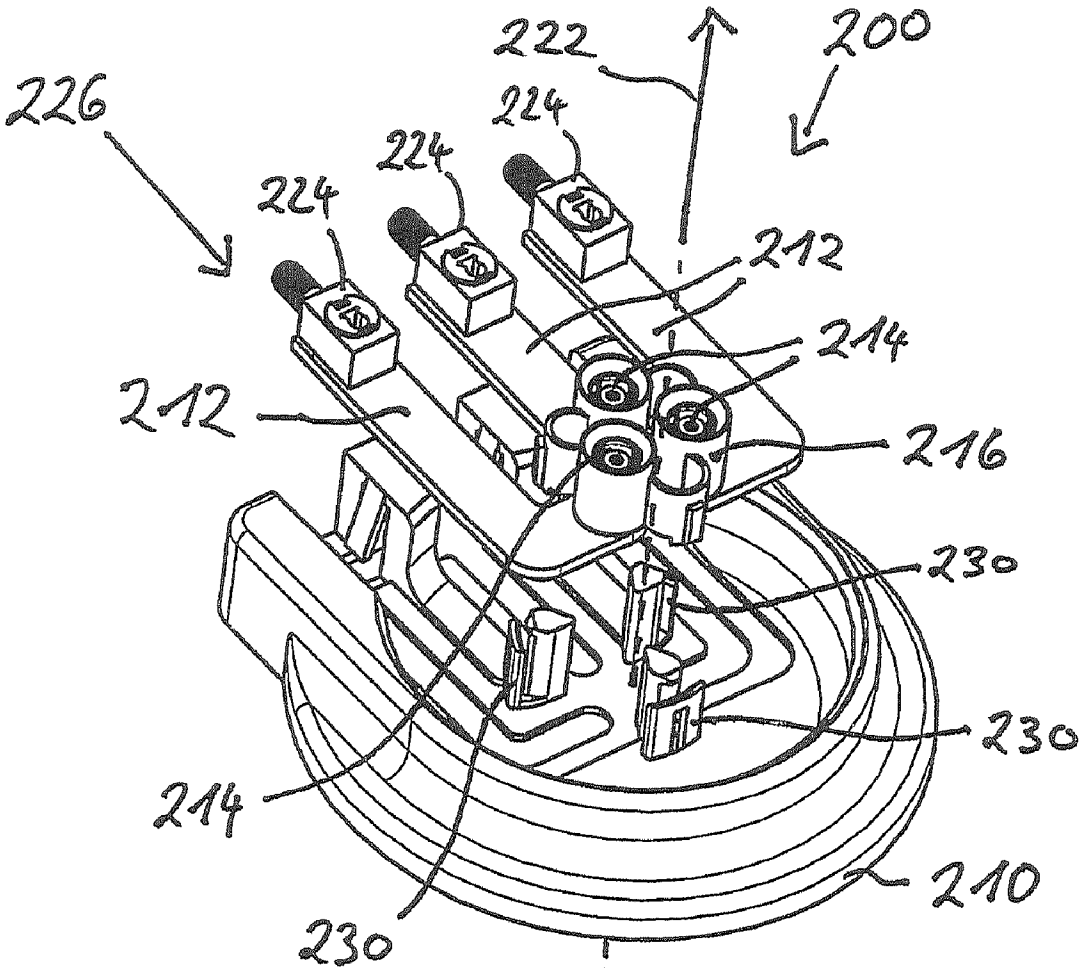
FIG. 6 is a perspective view showing the insertion-connected connector of FIG. 2 in the partly assembled state.
Figure 7:
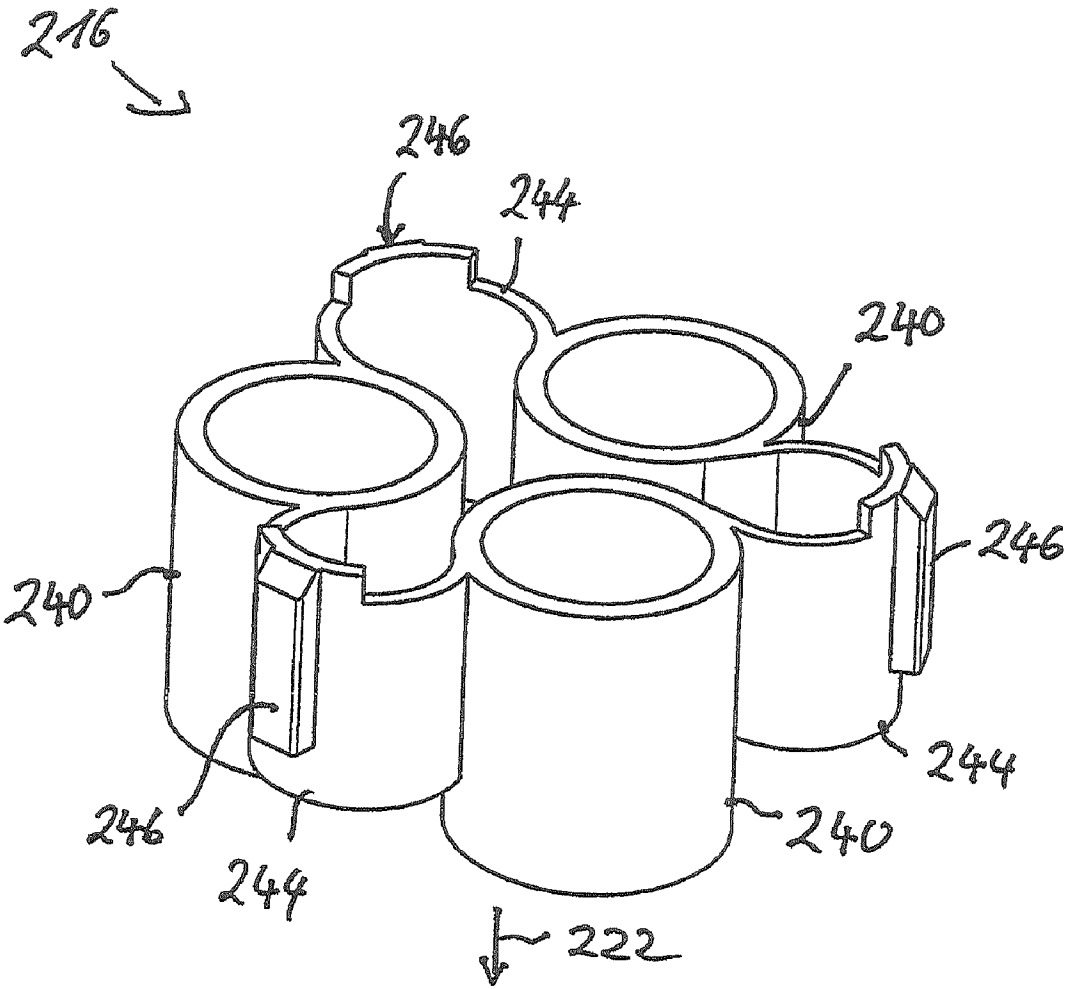
FIG. 7 is a perspective view from below of the resilient housing of the insertion-connected connector of FIG. 2.
Figure 8:
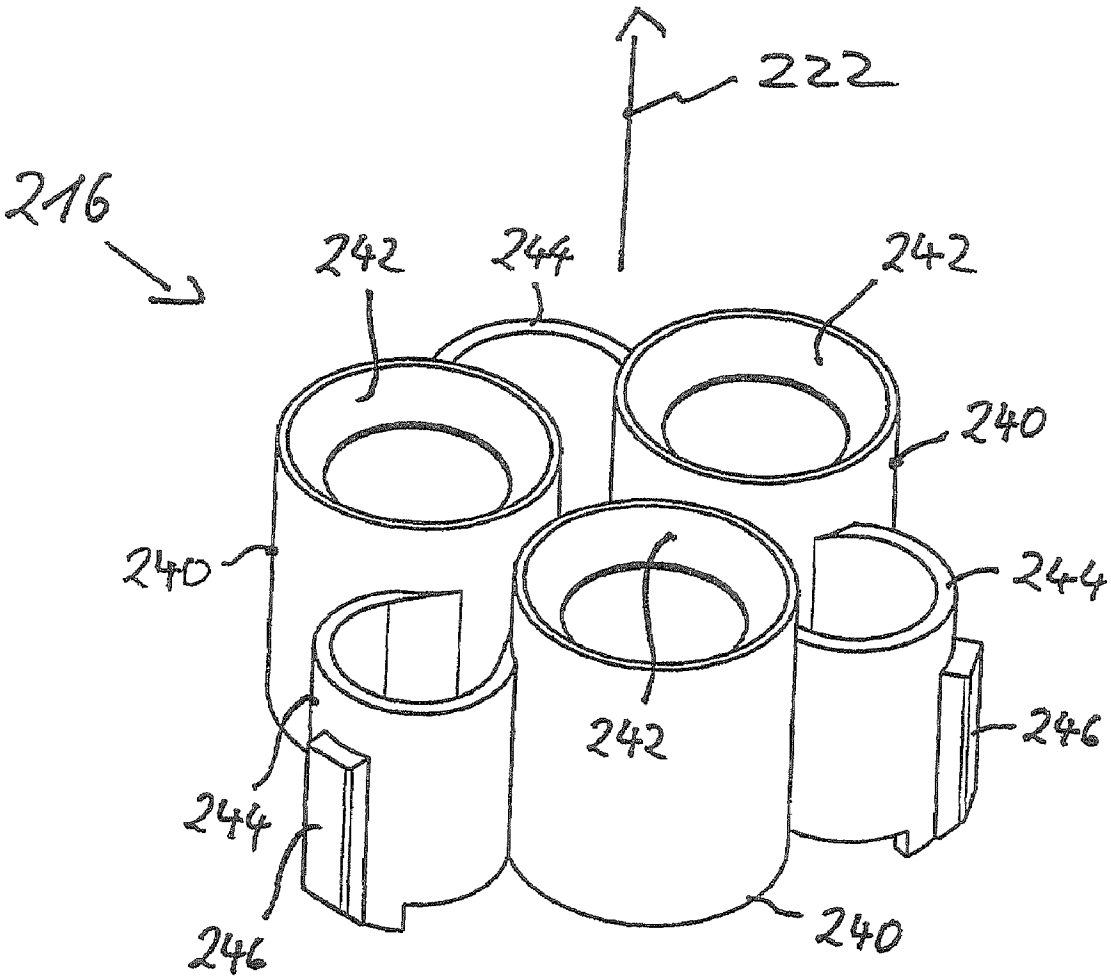
FIG. 8 is a perspective view from above of the resilient housing of the insertion-connected connector of FIG. 2.
Figure 9:
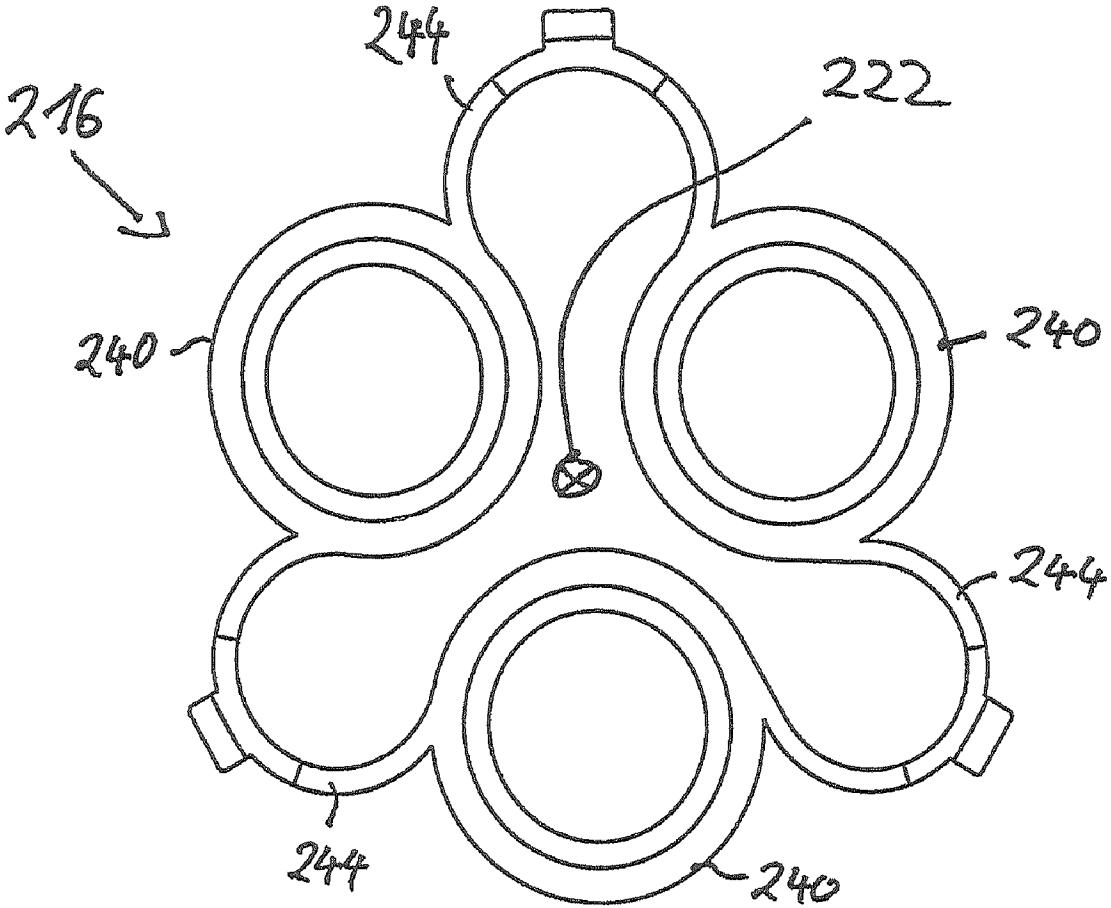
FIG. 9 is a plan view of the resilient housing of the insertion-connected connector of FIG. 2.

The second preferred embodiment of insertion-connected connector 200 according to the invention, which can be seen in FIGS. 2 and 6, comprises a housing 210, three signal conductor members 212, three contact elements 214 and a resilient housing 216. Arrow 222 indicates a direction of insertion in which the insertion-connected connector 200 according to the invention can be inserted in a complementary insertion-connected connector or the latter's insertion interface, of for example a piece of equipment or a cable. In the present embodiment, this direction of insertion 222 is substantially perpendicular to a plane defined by the housing 210, which means that the connector concerned is an angle connector. This however is merely by way of illustration. The direction of insertion 222 could also be in line with a longitudinal axis of the insertion-connected connector, which means that it would then not be an angle connector but a straight connector.

Figure 4:
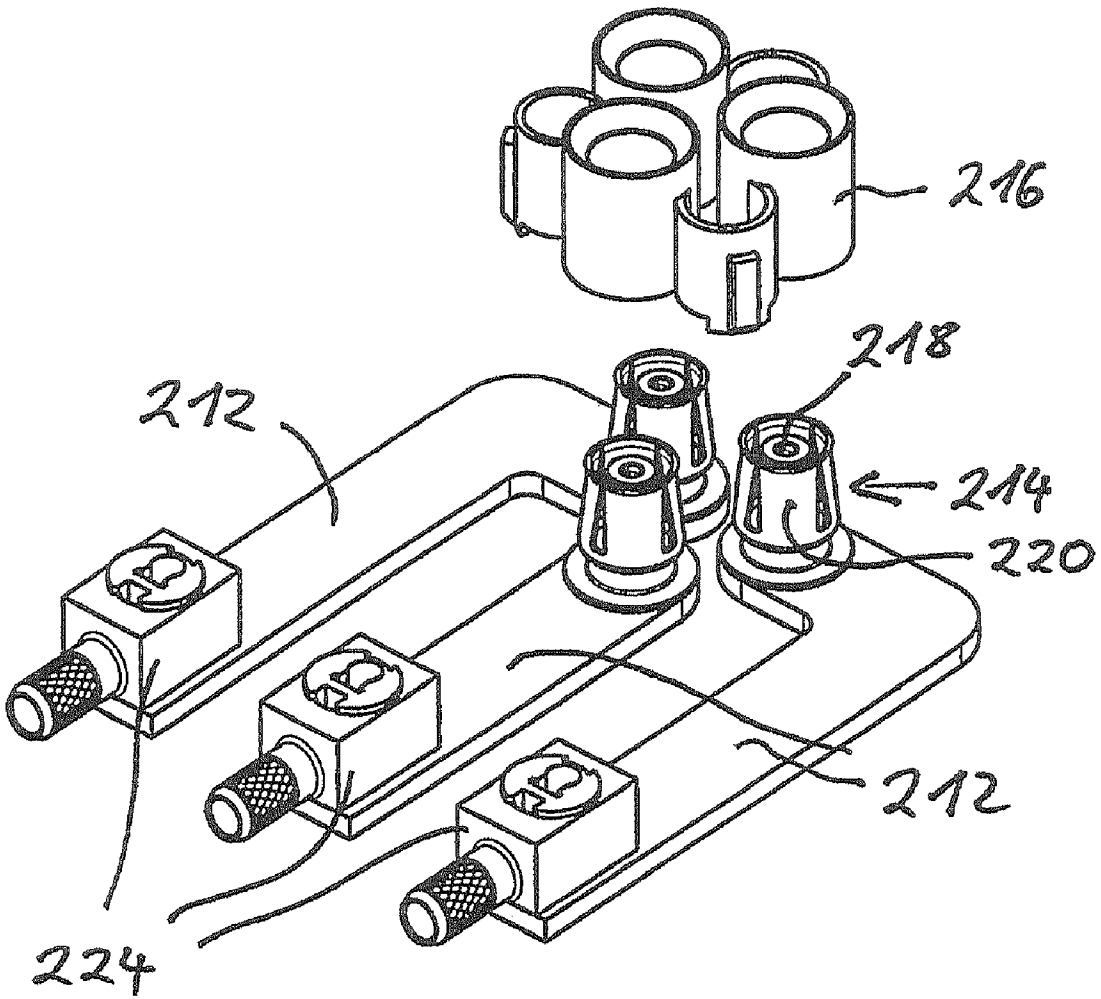
FIG. 4 is an exploded view showing the contact elements, signal conductor members and resilient housing.

As can be seen from FIG. 4 in particular, the contact elements 214 are in the form of co-axial insertion-connected connectors having a centre conductor 218 and an outer conductor 220. The signal conductor members 212 are in the form of respective strip lines which extend in a plane perpendicular to the direction of insertion 222 and which each connect a co-axial insertion-connected connector 214 to a cable connection 224 at a cable end 226 of the insertion-connected connector 200. The strip lines 212 are for example formed by three conductor tracks which are stacked one on top of the other in a sandwich-like arrangement, with the centre conductor track transmitting the HF electrical signal and the two outer tracks being connected to earth to screen the signal conductor electrically.

Figure 3:
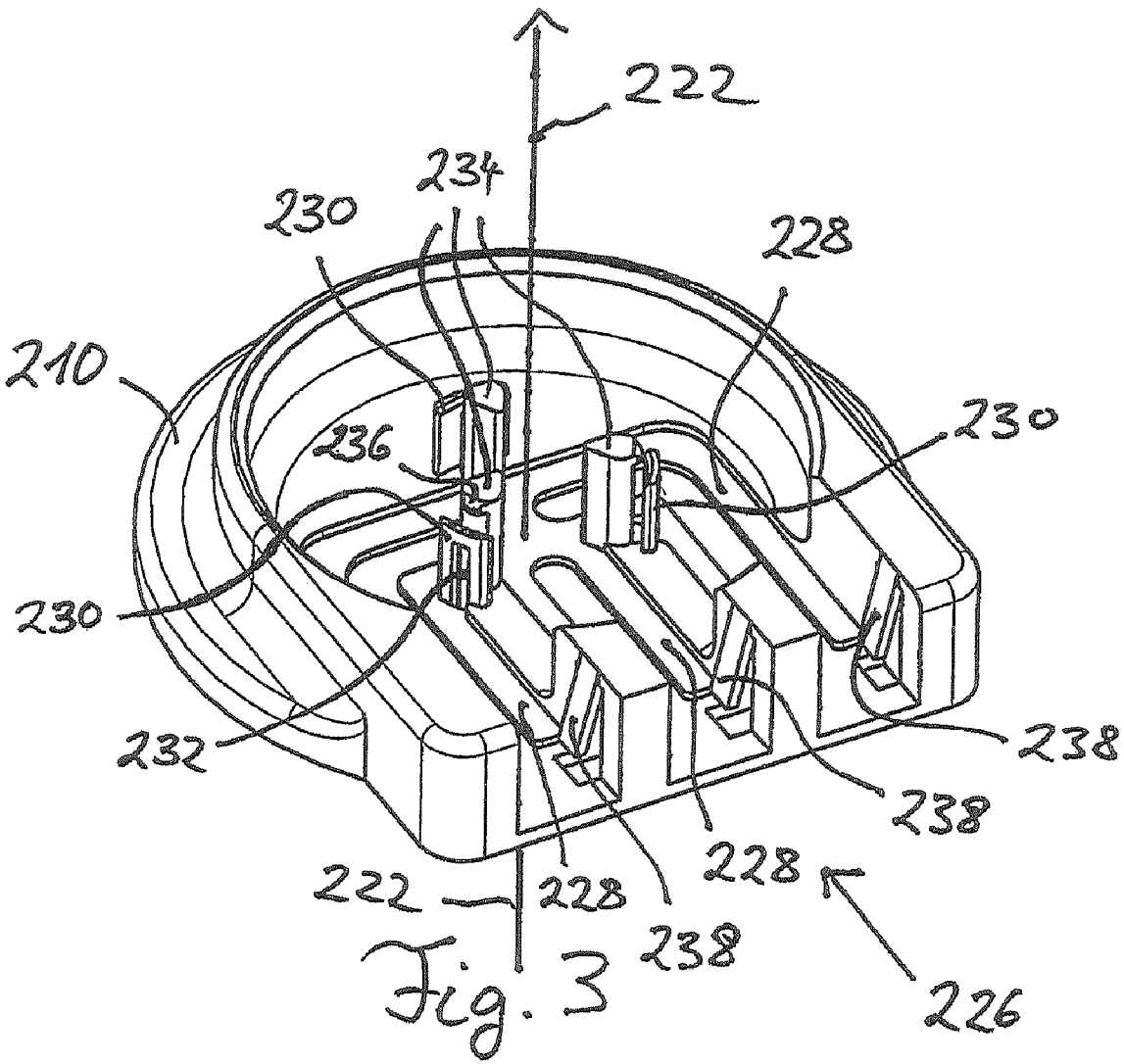
FIG. 3 is a perspective view of the housing of the insertion-connected connector shown in FIG. 2.

As is shown in particular in FIG. 3, the housing comprises recesses 228 to receive respective ones of the strip lines 212. These recesses 228 are so sized that the strip lines 212 are able to move in a plane perpendicular to the direction of insertion 222. From a floor of the housing 200 rise first latching means 230 in the form of elastically resilient tongues having respective recesses 232. Also rising from the floor of the housing 200 are latching spigots 234 having respective latching noses 236 which are designed to latch into an insertion interface of a mating insertion-connected connector or of the case of a piece of equipment (not shown) to connect the housing 200 mechanically to the mating insertion-connected connector or the case of the piece of equipment. Formed at the cable end 226 of the housing 210, there are also elastically resilient latching tongues 238 which are provided to fasten the strip lines 212 to the housing 210 at the cable end 226, as can be seen in particular from FIG. 2.

The resilient housing 216, which can be seen in more detail in FIGS. 5 and 7 to 9, comprises three sleeves 240 of electrically insulating material which each surround a co-axial insertion-connected connector 214. At an end facing in the direction of insertion 222, the sleeves 240 are provided at their circumference with a bevel 242 which acts as a region for taking hold of corresponding complementary co-axial insertion-connected connectors when the insertion-connected connector 200 according to the invention is inserted in the insertion interface of a complementary mating insertion-connected connector. By means of elastically resilient members 244, the sleeves 240 are connected together in such a way that the sleeves 240 form, together with the resilient members, the resilient sleeve 216 which on the one hand holds the co-axial insertion-connected connectors 214 at predetermined positions set by the desired measurements (the desired positions) and on the other hands allows the sleeves 240, and hence the co-axial insertion-connected connectors 214, to deflect elastically relative to one another, which means that, by making appropriate movements away from the desired positions set by the desired measurements, the co-axial insertion-connected connectors 214 are able to adjust to differences, due to tolerances, in the positions of the complementary co-axial insertion-connected connectors from their desired positions, which complementary connection-inserted connectors are rigidly arranged in the mating insertion-connected connector or insertion interface in which the insertion-connected connector 200 according to the invention is to be inserted. In other words, the insertion-connected connector 200 according to the invention allows three separate co-axial insertion-connected connectors to be plugged into corresponding complementary co-axial insertion-connected connectors at the same time without the said complementary co-axial insertion-connected connectors having to be arranged in the mating insertion-connected connector to satisfy excessive demands for low-tolerance positioning. This saves costs and manufacturing effort because the tolerances required are less stringent, or in other words because the permitted differences due to tolerances from the desired measurement or desired position on the part of the co-axial insertion-connected connectors 214 and complementary co-axial insertion-connected connectors are larger. The sleeves 240 and resilient members 244 form the resilient housing 216 and are formed in one piece with one another.

The resilient members 244 which connect the sleeves 240 in an elastically resilient manner are of a substantially Ω-shaped form in a cross-section perpendicular to the direction of insertion 222 and on their outside they carry second latching means 246 in the form of latching noses which fit into the recesses 232 in the tongues 230. Because of this arrangement, although the co-axial insertion-connected connectors 214 can be deflected from the desired position in an elastically resilient manner in the plane perpendicular to the direction of insertion 222, they are fixed in the direction of insertion 222.

Figure 5:
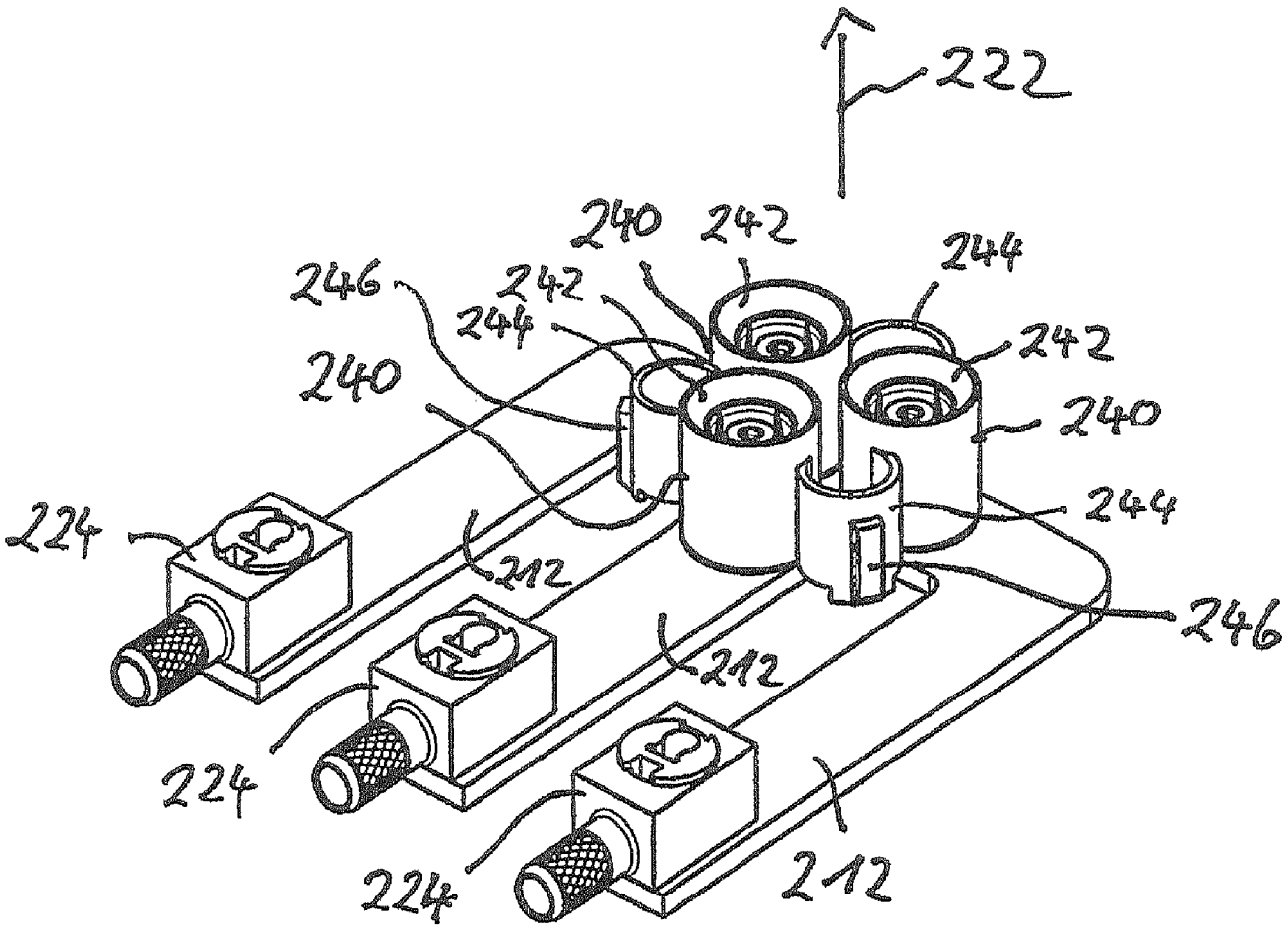
FIG. 5 is a perspective view showing the contact elements, signal conductor members and resilient housing in the assembled state.

When the insertion-connected connector 200 is being assembled, the resilient housing 216 is first slid over the co-axial insertion-connected connectors 214 so that each sleeve 240 receives a co-axial insertion-connected connector 214, as can be seen from FIGS. 4 and 5. The strip lines 212 are then slid into the recesses 228 in the housing 210 in the opposite direction to the direction of insertion 222 until the latching tongues 238 on the housing 210 latch over the strip lines 212 and the latching noses 246 on the resilient members 244 belonging to the resilient housing 216 latch into the recesses 232 in the tongues 230, whereby the respective arrangements comprising the co-axial insertion-connected connector 214, strip line 212 and cable connection 224 are connected to the housing 210 on the one hand, but on the other hand the co-axial insertion-connected connectors 214 are able to move relative to one another and away from their desired positions, by an amount of the same order as differences due to tolerances, due to the freedom of the strip lines 212 in the recesses 228 and the elastic resilient action of the resilient members 244 in a plane perpendicular to the direction of insertion 222.

As can be seen from FIGS. 2 and 6 in particular, the tongues 230 are of different widths. Because there are corresponding recesses in the insertion interface of the mating insertion-connected connector, what is thus available is a means of mechanical coding which prevents the insertion-connected connector 200 from being inserted in the insertion interface of the mating insertion-connected connector in a position to which it has been wrongly rotated. This ensures that the right co-axial insertion-connected connector 214 in the insertion-connected connector 200 always meets the right complementary co-axial insertion-connected connector in the insertion interface of the complementary insertion-connected connector.

The insertion interface is for example an arrangement of complementary co-axial insertion-connected connectors in the housing of a motor vehicle roof aerial having a plurality of aerials such for example as a mobile radio aerial and a GPS aerial. A co-axial insertion-connected connector of its own is provided for each aerial. The electrical connection between the aerial and the given terminal device, which in the present example are a mobile telephone and a GPS receiver, is made directly by inserting the insertion-connected connector 200 according to the invention in the insertion interface of the motor vehicle roof aerial. When this is done the respective co-axial insertion-connected connectors for the mobile phone aerial and the GPS aerial are plugged together simultaneously. Any additional cable connection can be dispensed with. The complementary co-axial insertion-connected connectors are each connected directly to their associated aerials. As well as an improvement in signal transmission due to the smaller number of joints along the signal path, what also results is simplified fitting, because the respective pairs of co-axial insertion-connected connectors and complementary co-axial insertion-connected connectors for the different aerials do not each have to be plugged together separately.

The invention claimed is:

1. An insertion-connected connector comprising a housing and having at least two electrical contact elements which each have a longitudinal axis and which are arranged in predetermined positions on an insertion side of the housing, orientated to have their respective longitudinal axes parallel to a direction of insertion of the insertion-connected connector, including having each electrical contact element in the form of a co-axial insertion-connected connector having a centre conductor and an outer conductor and arranged in the housing to be movable in a plane perpendicular to the direction of insertion and connected, in an elastically resilient manner, to at least one second electrical contact element by at least one electrically insulating elastic resilient member, the elastic resilient member being so arranged and formed that the electrical contact elements are, except for differences due to tolerances, pre-positioned at the respective predetermined positions and can be deflected, in an elastically resilient manner, from these locations in the plane perpendicular to the direction of insertion.

2. The insertion-connected connector of claim 1 including having the electrical contact elements arranged in the housing and movable in such a way that the mobility of the electrical contact elements in the plane perpendicular to the direction of insertion encompasses tilting of the longitudinal axes of the electrical contact elements or a displacement thereof in translation in a parallel position.

3. The insertion-connected connector of claim 1 including having each electrical contact element connected to a signal conductor member which in each case connects an electrical contact element electrically to a connecting point for a cable.

4. The insertion-connected connector of claim 3 wherein each signal conductor member comprises a co-axial line or a strip line.

5. The insertion-connected connector of claim 3 including having each signal conductor member formed to have electrical screening.

6. The insertion-connected connector of claim 3 wherein all the signal conductor members are arranged to extend in a plane at right angles to the direction of insertion, starting from the given contact element.

7. The insertion-connected connector of claim 3 including having each signal conductor member form a rigid component, and including a recess provided in the housing for each signal conductor member, such that each signal conductor member can be moved, together with the associated contact element, in a plane perpendicular to the direction of insertion.

8. The insertion-connected connector of claim 1 including having each electrical contact element surrounded by an electrically insulating sleeve and each sleeve of an electrical contact element connected in an elastically resilient manner to a sleeve of an adjacent electrical contact element by a respective electrically insulating elastic resilient member.

9. The insertion-connected connector of claim 8, wherein the resilient members are formed to be Ω-shaped in a cross-sectional plane perpendicular to the direction of insertion.

10. The insertion-connected connector of claim 8 wherein the sleeves and resilient members are formed to be in one piece with one another to form a resilient housing.

11. The insertion-connected connector of claim 1 including having a first latch formed on the housing, and on each resilient member a second latch is formed which, by co-operating with the first latch, fixes the resilient members to the housing.

12. The insertion-connected connector of claim 11 including having each first latch comprise an elastically resilient tongue which rises from the housing in the direction of insertion and which has a recess, with each second latch comprising a latching nose which rises from the given resilient member perpendicularly to the direction of insertion and fits into the recess in the resilient tongue comprising the first latch.

13. The insertion-connected connector of claim 12 including having at least one of the tongues comprise the first latch on the housing of a different width from the other tongues.

14. The insertion-connected connector of claim 1 including at least two, and in particular three, latching spigots rising from the housing in the direction of insertion, spaced apart from one another having respective latching noses which are formed to latch into a housing or insertion interface which carries contact elements complementary to the electrical contact elements of the insertion-connected connector.

15. The insertion-connected connector of claim 2 including having each electrical contact element connected to a signal conductor member which in each case connects an electrical contact element electrically to a connecting point for a cable.

16. The insertion-connected connector of claim 15 wherein each signal conductor member comprises a co-axial line or a strip line.

17. The insertion-connected connector of claim 16 including having each signal conductor member form a rigid component, and including a recess provided in the housing for each signal conductor member, such that each signal conductor member can be moved, together with the associated contact element, in a plane perpendicular to the direction of insertion.

18. The insertion-connected connector of claim 16 wherein all the signal conductor members are arranged to extend in a plane at right angles to the direction of insertion, starting from the given contact element.

19. The insertion-connected connector of claim 18 including having each electrical contact element surrounded by an electrically insulating sleeve and each sleeve of an electrical contact element connected in an elastically resilient manner to a sleeve of an adjacent electrical contact element by a respective electrically insulating elastic resilient member.

20. The insertion-connected connector of claim 19 wherein the resilient members are formed to be Ω-shaped in a cross-sectional plane perpendicular to the direction of insertion.

21. The insertion-connected connector of claim 15 including having a first latch formed on the housing, and on each resilient member a second latch is formed which, by co-operating with the first latch, fixes the resilient members to the housing.

22. The insertion-connected connector of claim 21 including having each first latch comprise an elastically resilient tongue which rises from the housing in the direction of insertion and which has a recess, with each second latch comprising a latching nose which rises from the given resilient member perpendicularly to the direction of insertion and fits into the recess in the resilient tongue comprising the first latch.

23. The insertion-connected connector of claim 15 including at least two, and in particular three, latching spigots rising from the housing in the direction of insertion, spaced apart from one another having respective latching noses which are formed to latch into a housing or insertion interface which carries contact elements complementary to the electrical contact elements of the insertion-connected connector.

* * * * *

UNITED STATES PATENT AND TRADEMARK OFFICE

CERTIFICATE OF CORRECTION

PATENT NO. : 7,479,034 B2
APPLICATION NO. : 11/908420
DATED : January 20, 2009
INVENTOR(S) : Willem Blakborn et al.

It is certified that error appears in the above-identified patent and that said Letters Patent is hereby corrected as shown below:

On the title page, item [75]:

Line (75) Inventors - delete "Jens-Peter Fruendt" and substitute therefore
-- Jens-Peter Freundt --

Signed and Sealed this

Twenty-first Day of April, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,479,034 B2
APPLICATION NO. : 11/908420
DATED : January 20, 2009
INVENTOR(S) : Willem Blakborn and Jens-Peter Freundt It is certified that error appears in the above-identified patent and that said Letters Patent is hereby corrected as shown below:

On the title page:

Item (73) Assignee: after "GmbH & Co.," please insert -- KG --

Signed and Sealed this

First Day of September, 2009

David J. Kappos

David J. Kappos
*Director of the United States Patent and Trademark Office*